United States Patent [19]

Lee et al.

[11] Patent Number: 4,791,275

[45] Date of Patent: Dec. 13, 1988

[54] HIGH TEMPERATURE COMPLIANT ROLL PARTICULARLY ADAPTED FOR XEROGRAPHY

[75] Inventors: Raymond Lee, Schaumburg; Gregory A. Ferro, Chicago, both of Ill.; John Evan, Atlanta, Ga.

[73] Assignee: IMI-TECH Corporation, Elk Grove Village, Ill.

[21] Appl. No.: 848,583

[22] Filed: Apr. 7, 1986

[51] Int. Cl.[4] ..... H05B 3/02

[52] U.S. Cl. ..... 219/469; 219/216

[58] Field of Search ..... 219/469–471, 219/244, 216, 204; 29/110–132; 165/89; 264/26, 54; 352/3 FU, 14 FU; 432/60

[56] References Cited

U.S. PATENT DOCUMENTS

| | | | |
|---|---|---|---|
| 2,034,599 | 3/1936 | Van Marle . | |
| 2,291,005 | 7/1942 | Strang . | |
| 2,453,404 | 11/1948 | Bohlman et al. . | |
| 2,972,668 | 2/1961 | Wertberg et al. | 219/244 |
| 3,189,729 | 6/1965 | Lusebrink | 219/244 X |
| 3,264,978 | 8/1966 | Staley . | |
| 3,401,439 | 9/1968 | Staats et al. | 219/244 X |
| 3,449,548 | 6/1969 | Adamek . | |
| 3,756,760 | 9/1973 | McBride | 29/132 |
| 4,192,989 | 3/1980 | Jeromin | 219/216 |
| 4,213,031 | 7/1980 | Färber | 219/244 |
| 4,305,796 | 12/1981 | Gagliani et al. | 264/54 X |
| 4,320,714 | 3/1982 | Shimazaki et al. | 219/216 X |
| 4,372,246 | 2/1983 | Azar et al. | 219/216 X |
| 4,438,321 | 3/1984 | Moraw | 355/3 FU |
| 4,563,073 | 1/1986 | Reynolds | 219/216 X |
| 4,580,033 | 4/1986 | Sakurai | 219/216 |
| 4,618,240 | 10/1986 | Sakurai et al. | 219/216 X |
| 4,628,183 | 12/1986 | Satomura | 355/3 FU |
| 4,631,976 | 12/1986 | Noda et al. | 219/204 X |

FOREIGN PATENT DOCUMENTS

| | | | |
|---|---|---|---|
| 200260 | 11/1983 | Japan | 355/3 FU |

*Primary Examiner*—A. D. Pellinen
*Assistant Examiner*—A. Jonathan Wysocki

[57] ABSTRACT

A heated roll suitable for use as a fuser roll in a xerographic processes is formed from a sheet of flexible, resilient, polyimide foam. An electrical heating circuit is adhesively secured thereto. The circuit is preferably disposed between a pair of polyimide film sheets which, in turn, are secured to the foam.

5 Claims, 1 Drawing Sheet

HIGH TEMPERATURE COMPLIANT ROLL PARTICULARLY ADAPTED FOR XEROGRAPHY

Background of the Invention

This invention relates to the field of heated rolls and in particular those suitable for use in xerographic processes. Nevertheless the invention has utility in any environment in which a heated roll having a high temperature capability is required.

As is well known, in the xerographic copy process a photo sensitive drum is exposed with the image of the document or object to be copied. Toner is applied to the drum and sticks to the image of the drum or object. A sheet of paper then passes the drum where the toner image is transferred from the drum to the paper. The final step fixes the toner to the paper by fusing or melting it with heat.

The final step of fusing the toner is usually accomplished with a heated fuser roll having the electrical heating elements contained in the core thereof. Typical prior art fuser rolls comprise a heated metal roller having a compliant, synthetic polymer coating or cover thereover. Typically this coating or cover is silicone rubber based. Silicone rubber has a maximum, continuous operating temperature of approximately 400° F. In order for the toner image to be evenly heated it is necessary that the silicone rubber coating be sufficiently thick to provide a compliant or resilient surface. As a result of this minimum thickness requirement and the upper temperature limit of the silicone material, the surface temperature of the fuser roll is limited to about 300° F. (due principally to heat loss through the rubber).

This temperature limitation is a limiting factor on the speed at which the toner can be fused and thus the operating speed (copies per minute) of a machine employing such a roll.

Obviously it is desirable to increase the speed at which quality copies can be made. To do so it is necessary to utilize surface temperatures greater than the maximum operating temperature of a conventional silicone rubber covered fuser roll.

Accordingly, it is an object of the present invention to provide a heated roll which is both compliant and capable of higher temperatures. This is accomplished, according to the present invention, by the use of a high temperature polymer in the form of a flexible, resilient foam in conjunction with a flexible, electric heating circuit which can be disposed on the *outside* of the foam for directly contacting the toner to be fused. This construction provides the resilience for good quality copies at high speeds and heat loss through the foam is avoided by surface mounting the heating element.

DETAILED DESCRIPTION

As indicated in the background portion of this specification, the present invention relates to heated rolls which are both resilient and capable of sustaining high temperatures on a continuous basis. These rolls may be used in several environments including paper calendering, heat sealing and laminating applications. They have, however, particular application to xerographic copying as fuser rolls. For purposes of best illustrating the invention it will be described in the context of a fuser roll.

Figure 1:
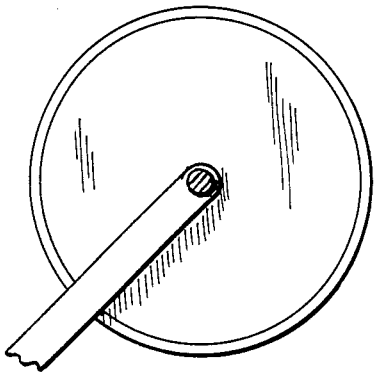
FIG. 1 is a side elevational view of a fuser drum or roll.

Referring to FIG. 1, a fuser roll according to the invention is illustrated. As is well known in the art (see, for example, U.S. Pat. No. 4,020,210), the heated fuser roll rotates to permit paper having a toner image thereon to pass through a nip formed by the fuser roll and a backing roll. If the fuser roll is maintained at a sufficiently high temperature and the paper speed through the nip is correct, the heat from the drum will melt or fuse the toner forming a permanent image on the paper. As also indicated in the background section, typical fuser rolls are limited to continuous operating surface temperatures of about 300° F. due to material and thickness requirements of the fuser roll, the latter requirement being necessary to provide adequate resiliency to insure even and thorough heating of the entire sheet of paper.

Figure 2:
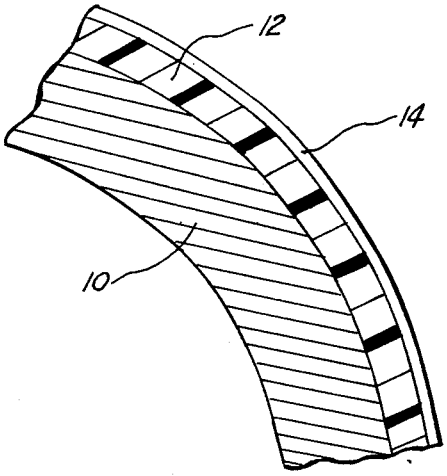
FIG. 2 is a sectional view, on an expanded scale, through the fuser drum of FIG. 1 to show the construction of the drum according to the present invention.

Referring to FIG. 2, a section of a fuser roll according to the present invention is shown in enlarged detail whereby the important aspects of the present invention may be understood. In place of the conventional fuser roll having internal heating and a resilient cover disposed over a metal case, the present invention employs an internal roll 10, preferably of metal for rigidity, on which is disposed a flexible resilient polymer material 12. This material is preferably a polyimide foam of the type disclosed in U.S. Pat. Nos. 4,315,080, Re. 30,213, 4,535,101, 4,539,342, and 4,535,099 assigned to the present assignee. In general, such foams are prepared from benzophenonetetracarboxylic acid dianhydride (BTDA), alcohol and diamines via a spray drying and microwaving process fully disclosed in U.S. Pat. No. 4,305,796. This polyimide foam has outstanding high temperature properties and is capable of withstanding, on a continuous basis, temperatures in the range of 400°-600° F. In addition, it has good resistance to compression set providing the resilience required for effective toner fusing. Although it would be possible to heat the metal roll 10 and fuse the toner indirectly through the polyimide layer 12, according to a preferred embodiment of the invention the heating element is instead provided on the outside surface of the foam 12 in the form of a flexible electrical circuit 14.

Figure 3:
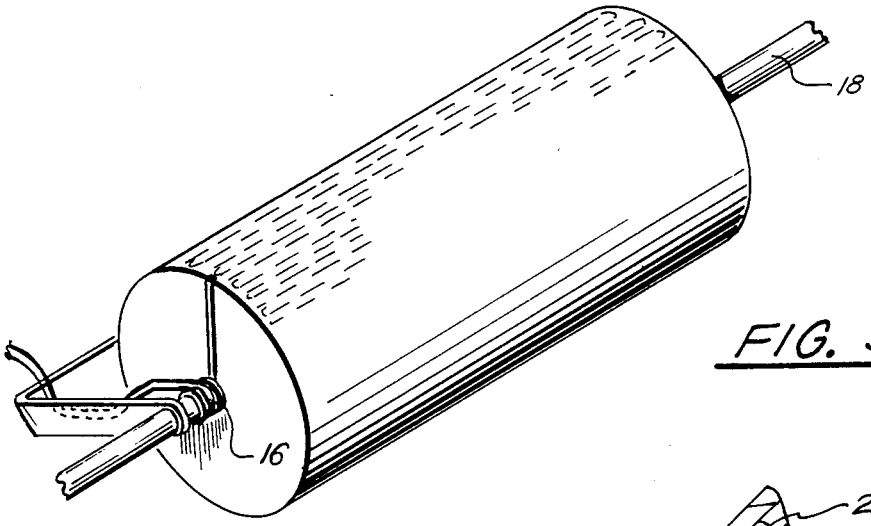
FIG. 3 is a front elevational view of the roll showing the electrical heat circuit.

As shown in FIG. 3, the circuit 14 comprises thin resistance wire which generates heat when electrical current passes therethrough. Electrical connections to the circuit are made via slip rings 16 disposed, for example, on either end of the support rod 18 for the roll. If desired, temperature sensing means, such as thermocouples, may be disposed on the surface of the circuit to precisely regulate the temperature.

Figure 4:
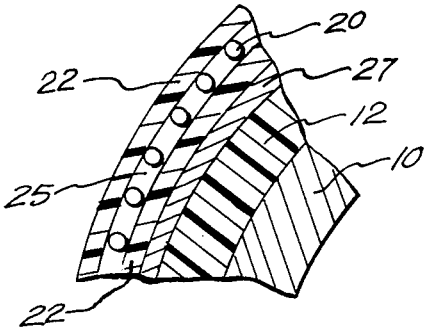
FIG. 4 is a fragmentary sectional view, on an expanded scale, through the fuser drum of FIG. 3 to show the construction of a preferred drum according to the present invention.

As shown in FIG. 4, the thin resistance wire 20 of the flexible circuit is preferably sandwiched between two sheets of polyimide film 22,22 which may be secured to each other by use of a heat activated adhesive 25. Suitable polyimide films include Kapton film made by DuPont. The advantage of encapsulating the circuit in the Kapton film is that is protects and isolates the circuit from direct contact with the toner. One of the sheets of film 22 is secured to foam 12 by a high temperature adhesive 27.

A fuser drum constructed according to the teachings of the present invention are capable of reaching surface temperatures of 400° to 600° F. on a continuous operating basis. The only upper limit on temperature is the temperature capability of the adhesive. The following examples illustrate various techniques for constructing a heated roll according to the present invention.

EXAMPLE 1

A compliant polyimide foam of the type described in U.S. Pat. No. Re. 30,213 having a thickness of approximately 0.5 inches and capable of withstanding temperatures in excess of 400° F. is secured to a Kapton polyimide film using a heat activated fluoropolymer adhesive, such as a fluorinated ethylene propylene adhesive available from DuPont. The bonding is achieved at approximately 525° to 560° F. under a pressure of from 0.5 to 50 psi. A flexible electric heating circuit, commercially available from Minco Products, Inc., Minneapolis, Minn., and a covering layer of Kapton film are then secured to the first layer of polyimide film using the same adhesive under similar activation conditions. The resulting cylindrical assembly of foam and encapsulated flexible circuit can then be mounted on a drum made of suitably rigid material. The adhesive is capable of operating at temperatures up to 450° F.

EXAMPLE 2

The assembly of Example 1 can be fabricated by first bonding the Kapton sheets to each other (with the electric circuit contained therebetween) and then bonding the assembly to the polyimide foam.

EXAMPLE 3

The assemblies of Examples 1 and 2 can be obtained using a silicone based adhesive in place of the fluorinated ethylene propylene adhesive. A suitable silicone adhesive is manufactured by General Electric under the name RTV 560 Silicone Rubber Adhesive. This adhesive cures or vulcanizes at room temperature and is capable of operating at temperatures up to approximately 500° F.

EXAMPLE 4

The assemblies of Examples 1–2 can be obtained using a flexible polyimide adhesive, such as M&T Chemicals 4605–4. The bonding can take place at temperatures of about 500° to 550° F. and pressures of 0.5 to 50 psi. This adhesive is capable of operating at temperatures up to approximately 550° F.

The combination of (1) a high temperature compliant roll formed of polyimide foam and (2) the use of an externally mounted, flexible heating circuit provides a capability not heretofore available in the art. Copies can be obtained more quickly due to the higher operating temperature obtained from a fuser roll manufactured according to the present invention.

While we have shown and described embodiments of this invention in some detail, it will be understood that this description and illustrations are offered merely by way of example, and that the invention is to be limited in scope only by the appended claims.

What is claimed is:

1. A roll for heating a surface bought in contact therewith comprising:

(a) a cylindrical layer of flexible, resilient polyimide foam capable of withstanding, on a continuous basis, temperatures within the range of 400° F. to 600° F.;

(b) electrical heating means comprised of a flexible electric circuit encapsulated between two sheets of a high temperature resistant polyimide film secured together by a high temperature adhesive, said electrical heating means being secured to the exterior of the foam by a high temperature adhesive, both said adhesives being capable of operating at temperatures up to at least 450° F.; and (c) a relatively rigid cylinder over which the foam is concentrically disposed for support and rotation;

whereby the heating means is adapted to be brought into compliant contact with a surface to be heated by rotation of the roll;

said roll being capable of reaching surface temperatures within the range of 400° F. to 600° F. on a continuous operating basis.

2. A roll according to claim 1 wherein each said adhesive is a fluoropolymer adhesive.

3. A roll according to claim 1 wherein each said adhesive is a silicone adhesive.

4. A roll according to claim 1 wherein each said adhesive is a polyimide adhesive.

5. A roll according to claim 1 wherein said polyimide foam is produced from benzophenonetetracarboxylic acid dianhydride, alcohol and diamines via a spray drying and microwaving process.

* * * * *